US005676631A

United States Patent [19]

Kunz et al.

[11] Patent Number: 5,676,631

[45] Date of Patent: Oct. 14, 1997

[54] CENTRIFUGE DRUM FOR CONCENTRATING SUSPENDED SOLIDS

[75] Inventors: Herbert Kunz, Osnabrück; Konrad König; Dieter Schulz, both of Oelde, all of Germany

[73] Assignee: Westfalia Separator Aktiengesellschaft, Oelde, Germany

[21] Appl. No.: 758,801

[22] Filed: Dec. 3, 1996

Related U.S. Application Data

[63] Continuation of Ser. No. 564,173, filed as PCT/EP94/01718 May 26, 1994, published as WO95/01841 Jan. 19, 1995, abandoned.

[30] Foreign Application Priority Data

Jul. 6, 1993 [DE] Germany ..... 43 22 415.6

[51] Int. Cl.[6] ..... B04B 1/08

[52] U.S. Cl. ..... 494/71

[58] Field of Search ..... 494/56, 67, 68, 494/69, 70–73

[56] References Cited

U.S. PATENT DOCUMENTS

| | | | |
|---|---|---|---|
| 1,475,323 | 11/1923 | Schmucking | 494/70 X |
| 2,478,992 | 8/1949 | Wheelwright, Jr. . | |
| 2,488,747 | 11/1949 | Strezynski | 494/70 X |
| 2,599,619 | 6/1952 | Eckers | 494/73 X |
| 2,636,670 | 4/1953 | Aspegren | 494/71 X |
| 3,192,149 | 6/1965 | Keith, Jr. | 494/70 X |

FOREIGN PATENT DOCUMENTS

| | | | |
|---|---|---|---|
| 1517424 | 3/1968 | France . | |
| 1297036 | 6/1969 | Germany . | |
| 3320152 | 12/1984 | Germany . | |
| 757743 | 11/1932 | Switzerland | 494/56 |
| 381913 | 10/1932 | United Kingdom | 494/56 |
| 658775 | 10/1951 | United Kingdom | 494/70 |

*Primary Examiner*—Charles E. Cooley

*Attorney, Agent, or Firm*—Sprung Kramer Schaefer & Briscoe

[57] ABSTRACT

A centrifuge drum for concentrating suspended solids, has a peripheral solids collection chamber having outlet channels, a plate insert of disks communicating at a peripheral area with the solids collection chamber such that solids precipitating in the plate insert are conveyed to the solids collection chamber and an inlet chamber through which suspension being clarified is conveyed. The plate insert has central channels for diverting clarified suspension and outer rising channels extending upwardly therethrough with inlets in communication with the inlet chamber and outlets. Diverting channels are in communication with the outlets of the rising channels and have radially outward sections in communication with the solids collection chamber for diverting solids thereto and radially inward sections with outlets for diverting a solids loaded partial stream.

5 Claims, 1 Drawing Sheet

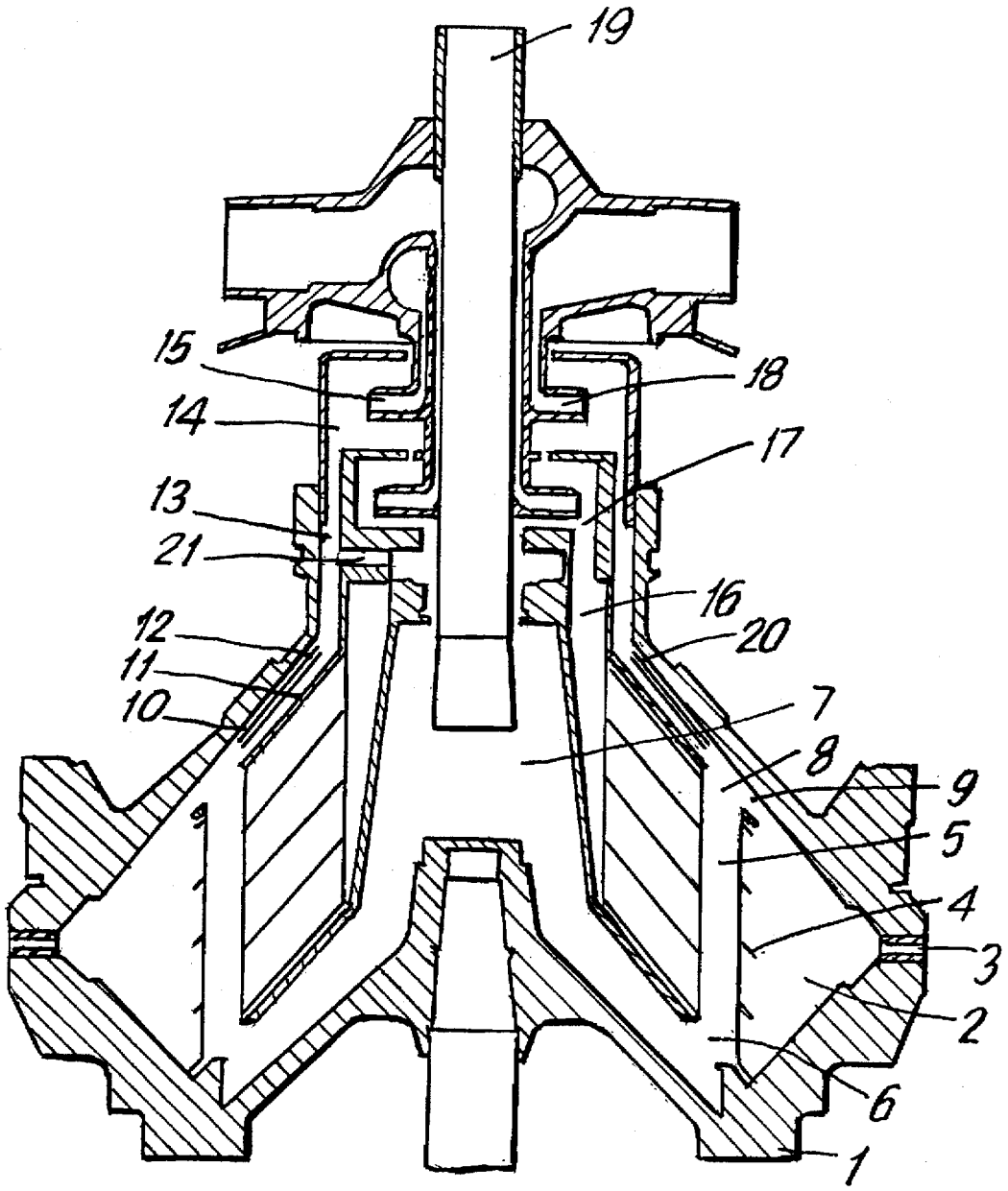
19
15
18
14
17
13
21
16
12
20
11
10
7
8
9
5
4
3
2
6
1

CENTRIFUGE DRUM FOR CONCENTRATING SUSPENDED SOLIDS

This application is a continuation of application Ser. No. 08/564,173, filed as PCT/EP94/01718 May 26, 1994 published as WO95/01841 Jan. 19, 1995, now abandoned.

BACKGROUND OF THE INVENTION

The present invention concerns a centrifuge drum for concentrating suspended solids. The drum has a peripheral solids-collection chamber and a plate insert of disks. The solids-collection chamber is provided with outlet channels. The plate insert has rising channels extending through it. The entrances into the rising channels communicate with the inlet chamber that the suspension being clarified is conveyed through. There are channels at the center of the plate insert for diverting the clarified suspension. The plate insert communicates at its periphery with the solids-collection chamber such that any solids that precipitate in the plate insert are conveyed into the solids-collection chamber.

A centrifuge drum of this type is known from German 3 320 152 A1. The precipitated solids accumulate in the solids-collection chamber and are continuously extracted through the outlet channels. To increase the concentration of solids, the outlet channels are thin enough to prevent as much liquid as possible from escaping with the solids. As the concentration increases, of course, the layer of solids that forms in the solids-collection chamber propagates radially inward until some of the solids enter the rising channels and will be extracted along with the centripetally flowing clarified suspension. This situation is detrimental to the clarity of the suspension. There is accordingly always a compromise between the maximal concentration of the solids and optimal suspension clarity.

SUMMARY OF THE INVENTION

The object of the present invention is to improve the centrifuge drum to the extent that the clarity of the suspension will be extensively unaffected by the concentration of the solids.

This object is attained in accordance with the present invention in that the rising channels have outlet apertures that communicate with the solids-collection chamber through channels having radially inward channel sections with outlets that allow separate diversion of a solids-loaded partial stream.

It has surprisingly been discovered that separately diverting a solids-loaded partial stream out of the outlet apertures from the rising channels through the radially inward outlet apertures from the channels eliminates the need to convey the solids to the center of the plate insert and the concomitant detriment to the clarity of the suspension. Some of the solids in the partial stream are simultaneously precipitated in the communicating channels and returned to the solids-collection chamber.

The communicating channels in one practical embodiment of the present invention constitute clarification interspaces. The clarification interspaces facilitate the precipitation of the solid particles sliding along their radially outer wall and into the solids-collection chamber.

The clarification interspaces can in a practical way be constituted between the conical inner surface of the centrifuge drum and the concentric outer surface of an intermediate disk, the latter surface being provided with spacers. This approach provides particularly ample surfaces for the solids to precipitate on in the clarification interspaces, even more ample because of the disks therein.

BRIEF DESCRIPTION OF THE DRAWING

One embodiment of the present invention will now be specified with reference to the single FIGURE.

DETAILED DESCRIPTION OF THE INVENTION

A centrifuge drum 1 has outlet channels 3 extending out of its solids-collection chamber 2. Drum 1 is provided with a plate insert 4 of disks. Rising channels 5 extend up through the disks and communicate with a inlet chamber 7. There are entrances 6 at one end of the rising channels 5 and outlet apertures 8 at the other. Outlet apertures 8 communicate with solids-collection chamber 2 through channels 9. Channels 9 are constituted between the inner surface of drum 1 and the concentric outer surface of an intermediate disk 11. The latter surface is provided with spacers 10. Channels 9 have radially inward channel sections 12. Channel sections 12 have outlets 13 opening into a chamber 14 that accommodates a skimmer 15. Whereas the periphery of plate insert 4 communicates with solids-collection chamber 2, the center of the plate insert communicates through channels 16 with a chamber 17 that accommodates another skimmer 18. A feed pipe 19 opens into inlet chamber 7. There are disks 20 between the inner surface of drum 1 and the outer surface of intermediate disk 11. Communicating channels communicate with inlet chamber 7 through channels 21.

The solids-loaded suspension is introduced into inlet chamber 7 through feed pipe 19 and enters the rising channels 5 in plate insert 4 through entrances 6. The solids are separated in plate insert 4. The clarified suspension flows toward the center of plate insert 4 and is diverted out of the drum through channels 16, skimming chamber 17, and skimmer 18. The separated solid particles arrive in solids-collection chamber 2 through the periphery of plate insert 4 before being extracted through outlet channels 3. The cross-section of outlet channels 3 is dimensioned to prevent as much liquid as possible from being diverted out with the solids in order to increase their concentration. The higher the concentration setting, the farther solids-collection chamber 2 will fill radially inwardly. When the concentration is very high, the particles will extend even into rising channels 5.

The solids are diverted out of plate insert 4 in a partial stream of the suspension supplied to rising channels 5 that is decanted continuously out of plate insert 4. Some of the solids are precipitated in the channels 9, which are in the form of clarification interspaces and provided with disks 20, and returned to solids-collection chamber 2.

The rest of the solids are decanted from drum 1 along with the partial stream by way of skimmer 15. The result is a screening action that allows types of solids not desired in the concentrate to be removed separately. This situation may occur for example when starch suspensions that contain undesirable fibers are concentrated.

Drum 1 can accordingly produce very high concentrations of solids without detriment to the clarified suspension while simultaneously removing another type of solid matter that would not be desirable in the concentrate.

When products that tend to foam are processed, any overflow from inlet chamber 7 can escape into skimming chamber 14 through channels 21 and 9. This will avoid detriment to the clarified phase diverted by way of skimmer 18.

We claim:

1. A centrifuge drum for concentrating suspended solids, comprising:

a. an inlet chamber through which suspension to be clarified is conveyed;

b. a peripheral solids collection chamber having outlet channels through which solid particles are diverted out of the drum;

c. a plate insert of disks having i. a peripheral area in communication with the solids collection chamber such that solids precipitating in the plate insert are conveyed to the solids collection chamber, ii. central channels for diverting clarified suspension from the disks and iii. outer rising channels extending upwardly through the disks and having inlets in communication with the inlet chamber and having outlets;

d. diverting channels in communication with the outlets of the rising channels and having i. radially outward sections in communication with the solids collection chamber for diverting solids to the solids collection chamber and ii. radially inward sections with outlets for diverting a solids loaded partial stream from the disks;

e. a first skimming chamber and a first skimmer receptive of the clarified suspension from the central channels for diverting the clarified suspension out of the drum; and f. a second skimming chamber and a second skimmer receptive of the solids loaded partial stream from the radially inward sections of the diverting channels for diverting the solids loaded partial stream out of the drum.

2. The centrifuge according to claim 1, wherein the diverting channels comprise clearances.

3. The centrifuge according to claim 2, further comprising an intermediate disk on the plate insert and wherein the clearances are between an inner surface of the drum and an outer surface of the intermediate disk and further comprising spacers on the outer surface of the intermediate disk.

4. The centrifuge according to claim 3, further comprising additional disks between the inner surface of the drum and the outer surface of the intermediate disk.

5. The centrifuge drum according to claim 1, further comprising communicating channels for communicating the outlets of the radially inward sections of the diverting channels with the inlet chamber.

* * * * *